US007335147B2

(12) United States Patent
Jones et al.

(10) Patent No.: US 7,335,147 B2
(45) Date of Patent: Feb. 26, 2008

(54) ADJUSTABLE LAPTOP HOLDER FOR EXERCISE EQUIPMENT

(76) Inventors: Andrea Sieg Jones, 2533 SW. Hamilton Ct., Portland, OR (US) 07239; Saumen Neil Bar, 182 Milkweed Ct., Three Bridges, NJ (US) 08887; Kweku David Fleming, 506 12th St., NE., Washington, DC (US) 20002; Bruce (Ying) Pan, One Amherst E40 - 315, Cambridge, MA (US) 02139; Howard Shen, 100 S. Alameda St. # 132, Los Angeles, CA (US) 90012; Dong Ik Kevin Shin, 482 7th St., New York, NY (US) 11215; Chun Hsien (Johnson) Wu, 11967 Sagemont Dr., Rancho Cucamonga, CA (US) 91739

( * ) Notice: Subject to any disclaimer, the term of this patent is extended or adjusted under 35 U.S.C. 154(b) by 0 days.

(21) Appl. No.: 11/466,436

(22) Filed: Aug. 22, 2006

(65) Prior Publication Data

US 2007/0066466 A1 Mar. 22, 2007

Related U.S. Application Data

(60) Provisional application No. 60/596,416, filed on Sep. 22, 2005.

(51) Int. Cl.
*A63B 23/00* (2006.01)

(52) U.S. Cl. ..... 482/148; 433/25

(58) Field of Classification Search ..... 482/148; 108/59; 602/60; 248/441.1; D24/176, 152; 433/25

See application file for complete search history.

(56) References Cited

U.S. PATENT DOCUMENTS

2006/0247109 A1* 11/2006 Powell ..... 482/148
2006/0258513 A1* 11/2006 Routley et al. ..... 482/54

* cited by examiner

*Primary Examiner*—Lori Amerson

(57) ABSTRACT

An apparatus in both single and multiple arm forms that adjustably and securely mounts to a variety of exercise equipment and provides adjustable and secure mounting for a laptop computer or similarly configured audio visual device. The apparatus allows for ergonomic access to the laptop or audio-visual equipment for users of various statures who use exercise equipment in various configurations.

18 Claims, 5 Drawing Sheets

ADJUSTABLE LAPTOP HOLDER FOR EXERCISE EQUIPMENT

CROSS REFERENCE TO RELATED APPLICATION

This application claims the benefit of U.S. provisional application No. 60/596,416 entitled "Adjustable Laptop Holder for Exercise Equipment," filed Sep. 22, 2005 pending.

FIELD AND BACKGROUND OF THE INVENTION

The present invention relates to the field of ergonometric devices and to the means for providing convenient, reliable access to computing equipment while actively using exercise equipment.

Exercising has become a regular part of many people's lives. As society has become more urban, people have had to adopt ways of exercising that are removed from active physical exertion through laborious work. They instead have come to rely on the use of exercise equipment as a substitute.

Many adults in developed countries do not engage in even 30 minutes of moderate activity each day. According to the Surgeon General's most recent report "more than 60 percent of adults do not achieve the recommended amount of regular physical activity. In fact, according to statistics at the US Center for Disease Control, 25 percent of all adults are not active at all. Many adults excuse themselves from exercise by claiming they do not have time to exercise. One of the things that occupies a large amount of time, especially for working professionals, is working on their laptop computers.

Over the past seven years, personal computer use has increased by 25%. Over that same time, internet use has increased by 36% according to NTIA data. More than half of all PC buyers are buying laptops. In May 2005, notebook sales accounted for 53% of total PC sales, up 7% from the previous year according to USA Today. This suggests an increasing trend for computer users with an increasing desire to be mobile. Furthermore, prices for mobile computing have decreased and the applications for laptop computer use have increased.

The next logical step for a typical non-active laptop user desiring more mobility and realizing that s/he needs to exercise more is to use his or her laptop while exercising. This allows the user to continue working while getting at least a moderate amount of physical activity.

A convenient form of exercising that is available at any hour is the exercise machine. Exercise equipment is designed to provide a user with active physical exertion while remaining in the same location. In the past, exercisers on machines have had limited options to occupy themselves on exercise machines. Many machines provide small shelves that can accommodate a book or magazine. Users will often times rely on portable listening devices (like tape, CD, or MP3 players) to keep their minds engaged during exercise. Many fitness centers offer television monitors near the machines, but programming choices can rarely be selected by individual users. And most inconveniently, users are not able to access their mobile computers while exercising.

This present invention provides a device that allows an exerciser to combine two activities that are important but have not been possible to do together in the past. By providing an adjustable laptop holder that mounts reliably to exercise equipment, users can maximize the value of their time by exercising and computing concurrently. Users now have a wide variety of options to keep themselves engaged during their workout. One option is pure entertainment: watching DVDs on the laptop screen, surfing the internet (subject to wireless access availability), or listening to music saved on the computer. Another option is to catch up on necessary tasks: reading email, newsletters online, online banking, headline surfing, etc. Additionally, users can even use their laptops for more specific work-related activities: participating in online conference calls requiring access to an online presentation, reading/writing work documents, and general work-related tasks involving the computer. Finally, users can integrate programs on their laptop with the exercise equipment to conduct analysis, digitize their exercise experience, or play games that use their motion as an input. They can also manipulate the computer via a controller or a mouse that is integrated with the apparatus or provided as an attachment to the exercise machine as part of the apparatus package. The possibilities are endless, and in an increasingly mobile and broadband world, having the option to use one's laptop while exercising is fast becoming a necessity.

Laptop holders are known in the art. Users can position their laptops on a mount standing on a desk or flat surface. Stands for laptops also can sit on a surface to which there is attached an extensible arm that is mounted to a flat surface. Freestanding laptop holders are also available, acting much like music stands for portability to any desired location. Mounting with a sleeve on a tube is also known in the art, though separately.

It is further known that a user might use an exercise machine and at the same time be tuned to a monitor or screen. Researchers at the Mayo Clinic have come up with a computer built into a treadmill. However, this requires a significant investment per treadmill/computer workstation and per square foot to redesign an office.

The present invention eliminates the need for costly renovations, and provides users with a means to use a regular laptop (and even their own laptop) while exercising. To date, an invention has not demonstrated a way to mount a laptop to a piece of exercise equipment in a way that is adjustable, secure, minimizes vibrations and provides appropriate ergonomic access to a laptop such that the user can use the laptop and the exercise equipment at the same time. The challenges with using a laptop on an exercise machine are three-fold: First, the laptop must be supported in a safe, stable and ergonomic manner to both the laptop and the user. Secondly, the laptop must be able to be positioned for users of different statures, as well as for use on various machines. Thirdly, the laptop holder must provide a convenient means of attachment to the exercise machine. A device providing the solution to this need has not been found in the art.

Reliably mounting a laptop to exercise equipment has been too cumbersome, too expensive, and too difficult. For this reason, this invention is novel and useful.

BRIEF SUMMARY OF THE INVENTION

The object of this invention is to provide a convenient, safe, and non-destructive means to attach a laptop to an exercise machine such as (but not limited to) an elliptical runner, treadmill, stair climber, or exercise bike. Another object of the invention is to provide a method by which a consumer can utilize a laptop in an ergonomically correct manner for viewing and/or typing while exercising.

An additional object of this invention is to provide a health club with an additional provision for exercisers wishing to maximize their efficiency and/or entertainment while exercising on fitness equipment.

An additional aim of the invention is to provide a device that can easily attach to an exercise machine and is adjustable by the user. This could incorporate two variations: one where the entire holder is attached to the machine at one time, and the other where a non-obtrusive universal "tab" piece remains mounted to the machine at all times, while the remainder of the holder is attached/detached more frequently.

Furthermore, the invention aims to provide a better quality of life to those who use laptop computers as they will be able to remain in motion without sacrificing valuable computing time. Also, this invention allows exercisers who get bored while using exercise machines to increase their entertainment options while exercising.

Additional advantages of the invention will become apparent as it is described and used by the public to provide additional resources to inactive people, and potentially reduce the growing obesity problem in the United States and around the world.

DETAILED DESCRIPTION OF THE INVENTION

Figure 1:
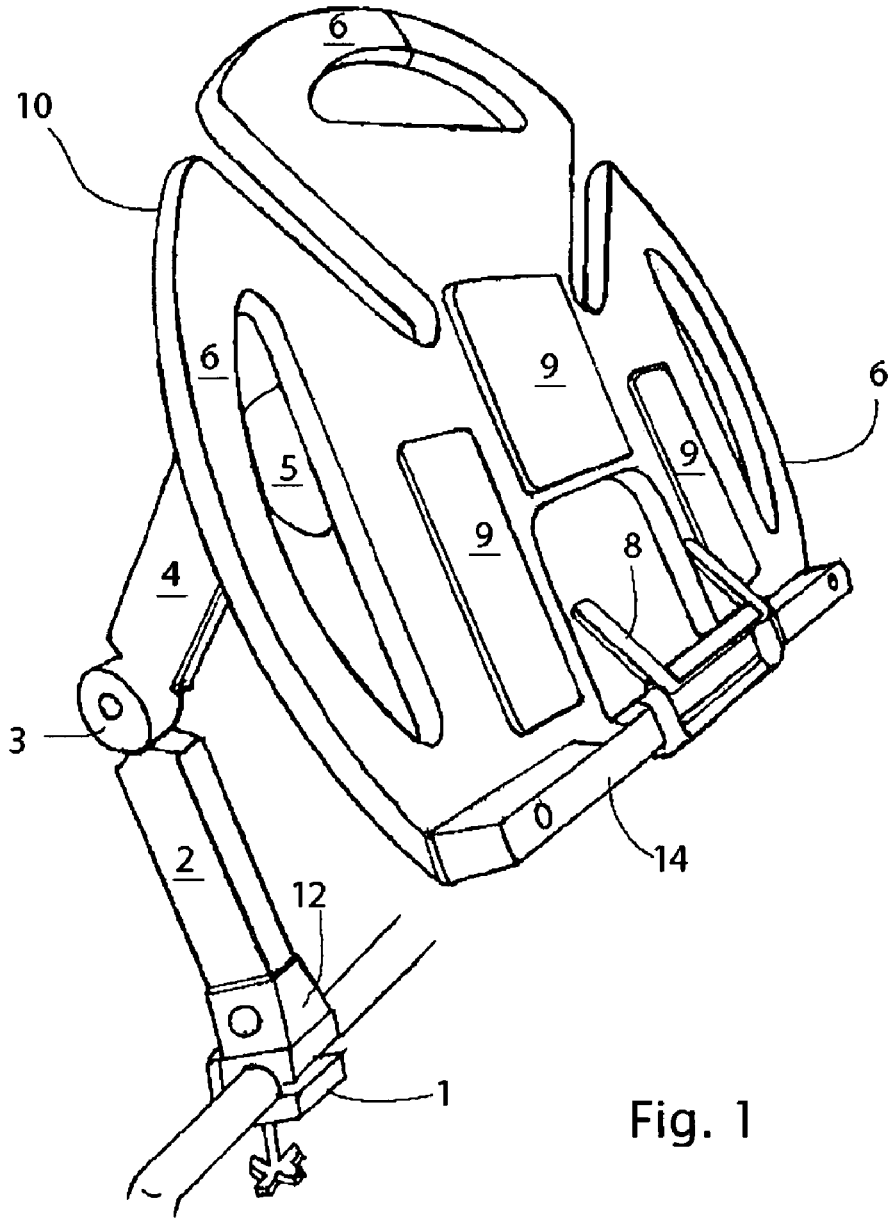
FIG. 1 shows the apparatus (10) in mounted form. A clamp (1) is mated and secured to a bar on the exercise equipment. Integrated with this clamp, a rotating base (12) allows the apparatus to rotate and lock. From this base extends an arm with arm segments (2) and (4) joined by a locking joint (3). A rotating joint (5) connects extension arm segment (4) to the laptop (7). Integrated with the laptop base are ergonomic gripping points (6), cushioning (9), and a protective clamp (8) to allow the laptop to be secured against the laptop base. A securing ledge (14) is padded and allows a safe resting place for the laptop.
Figure 2:
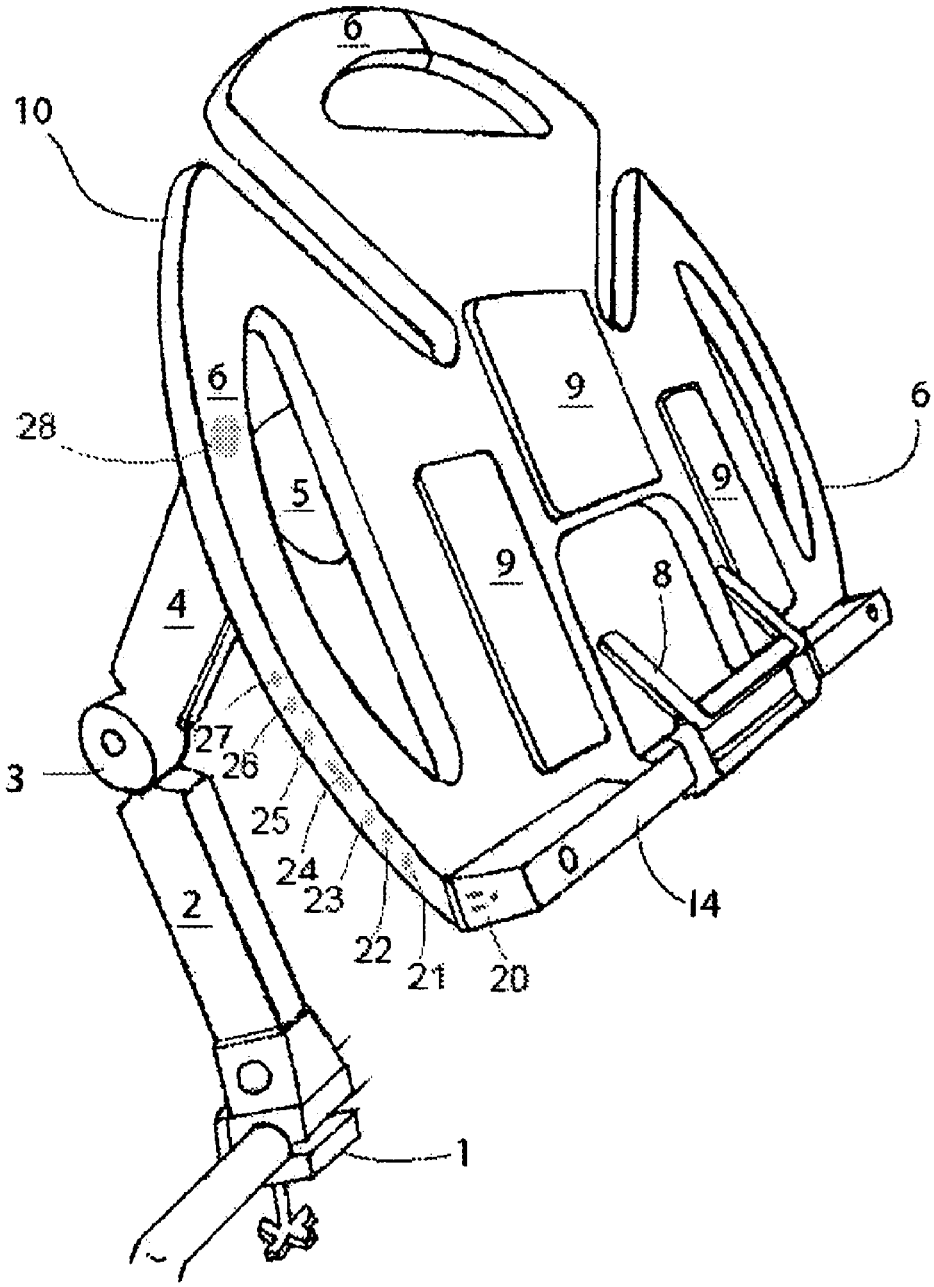
FIG. 2 shows the apparatus (10) as described above with built in power outlet (20), USB port (23), and input/output ports (21 & 22). Additional spare ports (24-26) are used for a variety of related purposes. Handle (6) features a trackball controller (27) that the user can integrate with his or her laptop.
Figure 3:
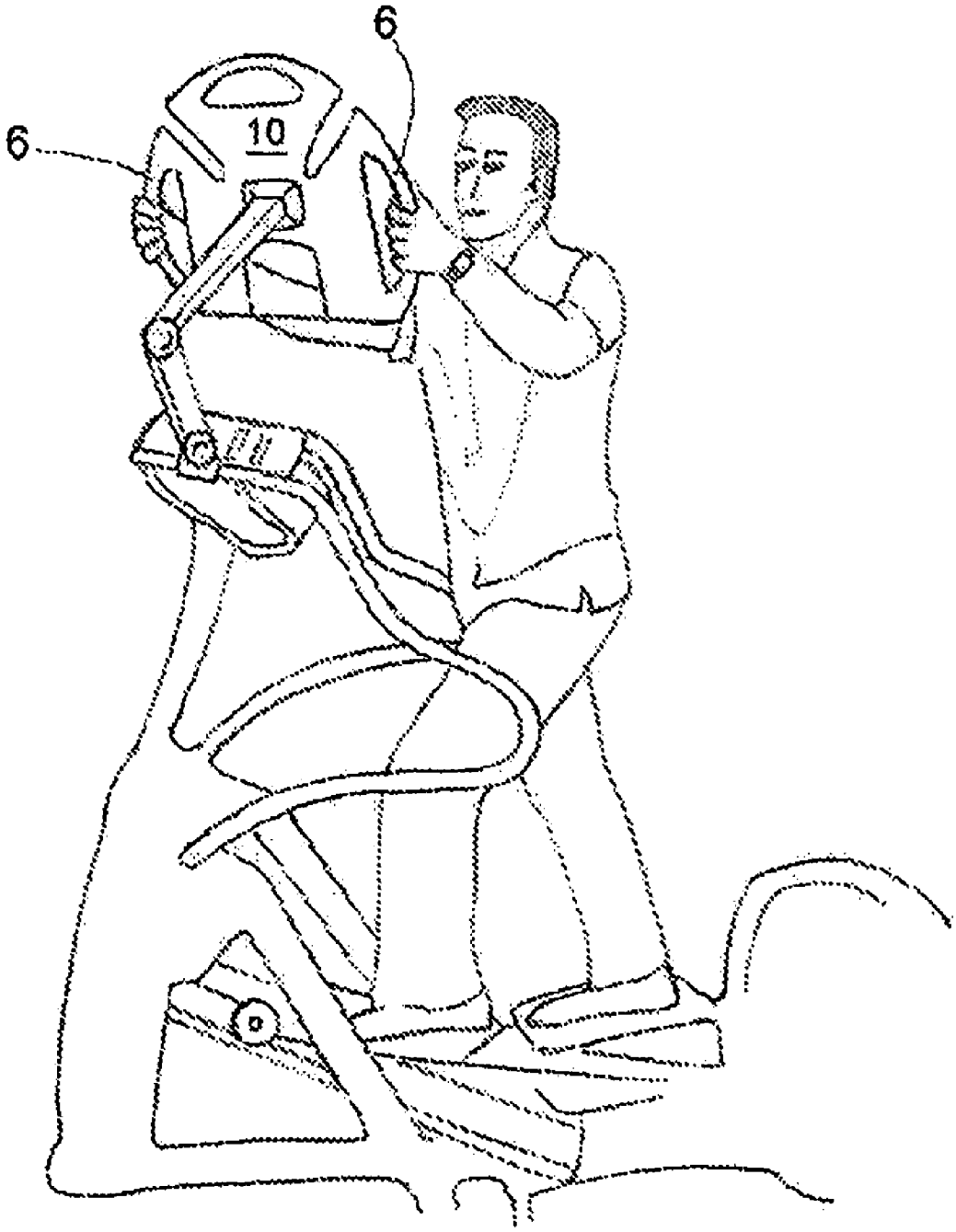
FIG. 3 shows the apparatus (10) in mounted form on an elliptical exercise machine (which is not the subject of this patent). A user, while actively exercising, can conveniently control the location of the apparatus for optimal laptop use. The user's left hand is optimally positioned to control an integrated trackball/mouse/controller. Of course, a user may choose to place other equipment or documents on the apparatus for use during exercise.
Figure 4:
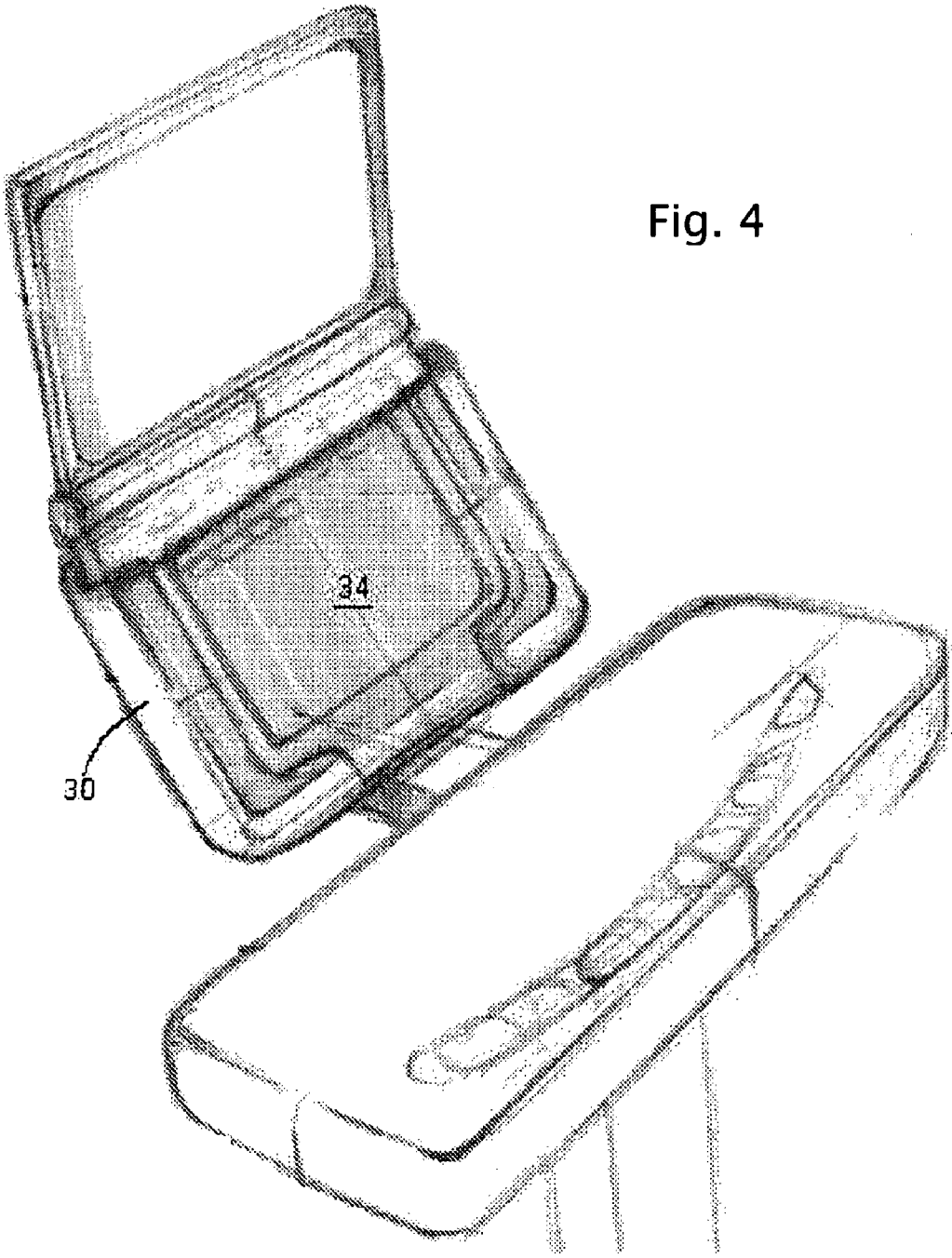
FIG. 4 shows the apparatus (30) in the pocket format in mounted form. The laptop keyboard slides into the pocket and is held in place with adjustable cushioned clamps. A clear cover (34) protects the laptop during use.
Figure 5:
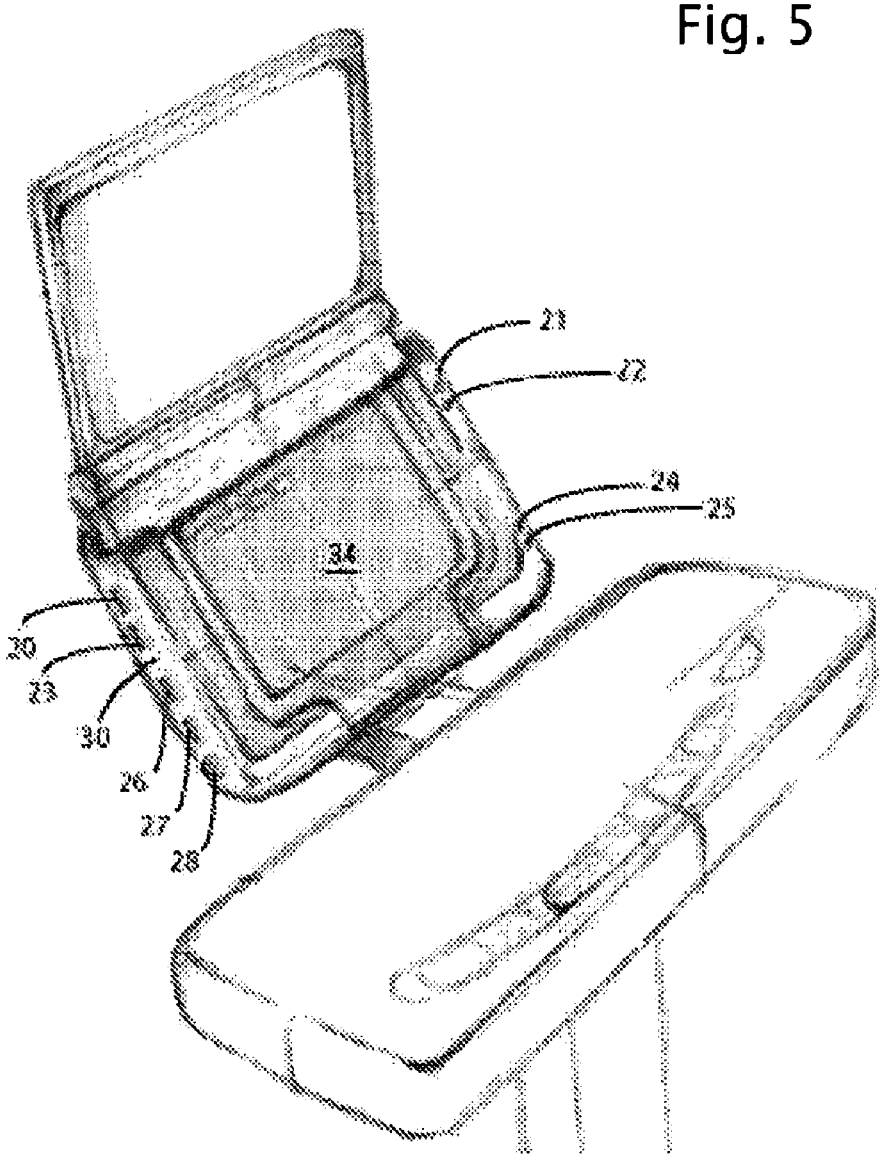
FIG. 5 shows the apparatus (30) in the pocket format in mounted form with cover (34) and built in power outlet (20), USB port (23), trackball controller (28), and input/output ports (21 & 22). Additional spare ports (24-27) are used for a variety of related purposes.

This invention provides a means to hold a laptop on a rotating or otherwise moving surface without incurring damage to the laptop. It is also intended to provide an ergonomically correct station for laptop use by users of the exercise machine to which the invention is attached.

In one embodiment, the users will walk/jog on a treadmill with the laptop on the holder ergonomically positioned in front of them for use. This embodiment could include a laptop holder directly attached to the treadmill, or available via a stand on or attached to the ground.

In another embodiment, users will move on an elliptical runner or stair climber with the laptop on the holder positioned in front of them for use. Again, the embodiment could include a laptop holder directly attached to the treadmill, or available via a stand on or attached to the ground. This embodiment provides a stationary holder that is available for ergonomic use in the neutral position of the elliptical runner or stair climber.

A third embodiment allows the user of a stationary bike to sit with the laptop on the holder positioned in front of him or her. Once again, the embodiment could include a laptop holder directly attached to the treadmill.

The primary embodiment of the laptop holder incorporates a rotating base that attaches to the exerciser, an extensible arm, a locking universal joint and an adjustable laptop pocket or platform to which is secured the laptop. The rotating base mates with the exercise equipment at the point of attachment. It is latched or tightened to minimize slack. Cushioning is provided to dampen the vibration. The extensible arm incorporates two segments joined by a locking joint. The laptop pocket is attached to the upper shaft with a universal joint, and incorporates a gripping handle for easily setting the location of the holder. When the holder is in correct position, it is easily locked. The laptop slips in the pocket and is secured with adjustable cushioned clamps.

The laptop holder can also be in the form of a platform that is attached to an arm and clamped to the exercise equipment. It could also be attached to a stand that is placed in front of, or behind the exercise equipment. The arm could be comprised of a hinge, an articulating goose-neck, a sliding cuff, or a locking joint. The user can position the platform to lie flat, or be tilted at an angle. The user can rotate the laptop toward or away from him/herself while exercising. Handling the device is made easy through the use of an integrated grip. In the various embodiments, a gripping device allows a user to conveniently and safely reposition the laptop holder.

Another convenient and ergonomic feature of the apparatus is the mouse trackball or controller. This allows the user to manipulate computer controls without having to touch the computer itself. This mouse/track ball/controller is positioned in some cases conveniently on the handle of the apparatus, while in other cases is a separate attachment positioned on the exercise equipment itself. Alternatively, the controller is worn by the user during exercise.

In another embodiment, the laptop holder comprises a "pocket" with a shield providing protection for the laptop from sweat, liquids, or other elements. In this scenario, the laptop is positioned at any angle from 0 to 180 degrees (depending on the allowable opening angle of the laptop itself).

With the present invention, it is contemplated that a user enters a fitness center. (note, this could of course be used for personal equipment at the user's home). After stowing his/her valuables, the user carries a laptop computer to an exercise machine that is equipped with the laptop holder. The user places the laptop on the laptop holder, secures it, and plugs in the power adapter. The holder is versatile in allowing users to plug their adapter cords into the laptop and a nearby outlet (one embodiment of the invention includes a built in powered outlet and input/output ports). The user then mounts the machine and begins his or her workout. The invention is placed such that it is not in the way of the machine's panel, or it can be temporarily moved out of the way of the panel. The user selects his or her workout and begins exercising.

At this point, the user has several options. If the laptop holder is not configured exactly right for the user's stature, an easy-to-use mechanism for adjusting the holder can be utilized. The user grips the holder with the integrated groups and adjusts. The user adjusts the holder to his or her liking. Release buttons and locking joints provide a way to set the position when the ideal positioning is reached. Then the user plugs in headphones, especially if audio will be heard or if a video is to be viewed. The user may also have his or her cell phone handy and call into conference calls. If wireless internet access is available (and the laptop can connect to it), the user may connect to web or network-based conference calls or meetings. The user may also use voice over IP to chat. As live stream videos and movies become increasingly available, this is also an option open to the user. The user may choose to simply read documents, catch up on email, surf the web, create documents, or perform any other task imaginable with a laptop computer, (while exercising!)

The instant invention makes all of the above activities easier through the use of a trackball/mouse/controller integrated into the apparatus itself, or positioned on the exercise equipment in a convenient location for the user. Likewise, the input/output ports incorporated into the apparatus make a wide variety of additional activities feasible.

Upon completing his or her workout, the user simply removes the laptop from the holder (ensuring that the adapter is unplugged if it was plugged in before) and leaves the equipment. The holder is designed to be resilient to being wiped down with a moistened cloth, as is common courtesy for exercisers to do after a workout.

In another scenario, the user carries both a laptop and the laptop holder to the exercise equipment. The user proceeds to set up the laptop holder on the equipment. If it is merely a stand, the user will just place the stand in front of, or to the side of the exercise equipment. If the laptop holder attaches to the exerciser, there are a few ways to attach it.

In the first attachment mode, a hinged tab is provided which folds, creating a void that echoes the shape of the cross-section of the exercise equipment at the point of attachment. This tab is closed around the exercise equipment and latched. When closed it pinches the exercise equipment bar with enough pressure to make it immovable until it is unlatched. Once the tab is attached, the laptop holder with a mating base is slid over the tab and fits snuggly and secures itself in place. (It can be removed by pressing a release and raising the laptop holder from the tab.) The laptop can then be securely mounted onto the laptop holder.

A variety of tab shapes may be used. A variety of tab sizes and shapes can be provided to attach to a variety of exercise equipment geometry. The tab can also be permanently affixed (with screws or similar connectors). Or the tab may form a quick release means for attaching to exercise equipment.

An alternative means for attaching the laptop holder to the exerciser is to integrate a clamp with the base of the laptop holder. This clamp secures the holder in place at the base, but allows rotation and extension from the base. There are other possibilities for clamping, clasping, mounting, securing, etc. the laptop holder to the exercise equipment that the user could perform prior to beginning his or her workout.

Once the laptop holder is attached to the machine, the user can begin his or her workout.

The laptop can be positioned in a way that is akin to the traditional "L" shape—keyboard on the horizontal plane, screen in a vertical plane. It could also be positioned so the laptop opened to a more full extent, with the keyboard ranging from the 90° horizontal plane to a full 180° vertical plane, in line with the monitor. The holder may be positioned directly in front of the user, or it may be positioned to the side of the user, with a convenient means of rotating the holder such that the laptop will be directly in front of the user. It is also possible that the holder could move from a lowered position up to the user's level, or conversely, from an upper position down to the user's level. In addition, it is possible that the holder will be attached to bars on the ceiling or wall and can retract to the user's level. The holder itself can be manipulated in several ways, such as vertically for convenient use by an exerciser whose height ranges from below 5' to over 7'. It can also be adjusted in the horizontal direction towards or away from the user, including at an angle up to a full 360° from the user's reference position.

In another embodiment, the holder will be stationed to the ground, either in an attached or non-attached configuration. This allows for maximum flexibility for use with any machine, and also could be removed from the machine's vicinity very easily.

The plethora of configuration possibilities provides convenient, flexible, and pliable methods of using a laptop on an exercise machine. It is believed that at least one of the variations will account for nearly all users' needs at several machines. The laptop holder is highly customizable and applicable by the user.

The device may be incorporated and sold with the exercise machine as an additional feature. It can also be sold as an after-market product, with minimal configuration required for adaptation on individual machines.

A wide variety of colors and materials may be incorporated and offered to the public. Other modifications to the device may be introduced and still remain within the spirit and scope of the invention.

What is claimed is:

1. An adjustable apparatus for movably and securely attaching a laptop or audio-visual device to a cylindrical bar, where the cylindrical bar is a component of an exercise machine or exercise equipment, comprising a tray with a substantially flat front surface, which determines a plane, an opposing back surface, and edges, at least one edge forming a first ledge that extends perpendicularly from the front surface; the front surface and perpendicular ledge configured to support the weight of a laptop or audio-visual device; the back surface having a single attachment point to which is connected a rotating joint for rotating the tray 180 degrees around an axis normal to the tray and 180 degrees around an axis in the plane of the tray, the rotating joint also attaching movably to an arm having a toy end and a bottom end, the top end being attached to the rotating joint and the bottom end being attached to a rotating base that has a top edge and a bottom edge, the arm being configured to adjust the distance between the top edge of the rotating base and the bottom surface of the tray, the rotating base further configured to allow rotation through 360 degrees in a vertical axis, the bottom edge of the rotating base attaching to a clamp, providing a means to clamp the arm to the exercise machine, the clamp being immovably attached to the exercise machine at a single point, the tray further comprising a means for securing the laptop to the tray, a means for stabilizing the laptop and a means for gripping and thereby manipulating the location and orientation of the tray.

2. The Apparatus of claim 1 where the exercise equipment features a bar having a diameter, a cross sectional shape, and a linear length and furthermore where the clamp includes a top jaw and a bottom jaw, a jaw connector, and a jaw bolt, the top jaw having a bottom surface that is substantially flat except where it has a first depression, the bottom jaw having a top surface that is substantially flat except where it has a second depression, the first depression being equal in size, shape, length and configuration to the volumetric shape of the top half of the exercise bar, the second depression being equal in size, shape, length and configuration to the volumetric shape of the bottom half of the exercise bar, the two jaws connected via a hinge along one edge and unconnected on an opposing edge so that the jaws can close around the bar, the jaws being secured by the jaw bolt and thereby mounting the laptop holder to the exercise equipment while creating a single point where the apparatus engages the exercise machine.

3. The apparatus of claim 1, wherein the arm comprises two shafts joined by a locking hinge.

4. The apparatus of claim 1, wherein the arm comprises a set of concentric sleeves that slide with respect to one another and lock to create adjustable length.

5. The apparatus of claim 1, wherein the tray rotates relative to the exercise machine around an axis normal to the ground and concurrently around an axis that is parallel to the ground.

6. The apparatus of claim 1 where two additional ledges located on opposing edges and of similar length to the first ledge extend perpendicularly from the front surface; a laptop holder cover that is substantially parallel to the tray attaches to all three ledges forming a pocket into which slides a laptop or audio visual device; the pocket consisting of material surrounding the laptop on at least 5 faces, two opposing tray edges having interior surfaces to which are affixed cushioned sliders and spring mechanisms for adjustably accepting laptops of different sizes.

7. The apparatus of claim 1, wherein the laptop securing means is a user-activated spring-loaded clamp with cushioned appendages attached to the tray and configured to protect the laptop or audiovisual device.

8. The apparatus of claim 1, wherein the laptop securing means includes a band that elastically wraps around the laptop or audiovisual device.

9. The apparatus of claim 1, wherein the laptop securing means is in the form of a strap and incorporates mating hook and loop closures, hooks, buttons or ties to adjustably secure the item being mounted.

10. The apparatus of claim 6, wherein the arm comprises two shafts joined by a movable hinge to create adjustable lengths.

11. The apparatus of claim 4, wherein the laptop securing means is in the form of a strap and incorporates mating hook and loop closures, hooks, buttons or ties to adjustably secure the item being mounted.

12. The apparatus of claim 1 further comprising an electrical power connecting means, laptop remote controlling means, a trackball/mouse controlling means, and data input/output means.

13. The apparatus of claim 11 further comprising the following components: A power receptacle, a power extension cord, a USB port, a mouse port, a trackball/mouse/controller input/output ports, laptop controlling switches, and an electrical power adapter.

14. The apparatus of claim 13 wherein the trackball/mouse/controller and the laptop controlling switches control functions and operations of the laptop.

15. A method of accessing a laptop computer or audio-visual device while utilizing exercise equipment, the method comprising the following steps: a) providing an adjustable laptop holder comprising a single point clamping means, a single pivoting base means, an extension means, a laptop mounting means, a gripping means, a laptop stabilizing means, and a laptop securing means; b) clamping the pivoting base securely to the exercise equipment without puncturing the equipment, c.) securing a laptop to the bolder, d.) using the gripping means to adjust the position of the laptop for easy manipulation and viewing.

16. The method of claim 15 further comprising the following steps: a.) providing an electrical power connection means, a power source, remote controlling means, an output to the holder, an input to the laptop, a trackball/mouse controlling means, b.) connecting the electrical power connection means to a the power source, c.) connecting the laptop to the electrical power connection means on the apparatus, d.) conecting the remote controlling means from the output on the holder to the input on the laptop, e.) selectively using the laptop remote controlling means and the trackball/mouse controlling means to control the functions of the laptop.

17. The method of claim 16 further comprising the following steps: i) measuring and digitizing the exercise activity as data and selectively using the digitized data as input for the laptop programs.

18. An adjustable apparatus for movably and securely attaching a laptop or audio-visual device to an exercise machine or exercise equipment, comprising the components: a single point clamping means, a single point rotating base, a single adjustable length arm, a laptop mounting means, a laptop securing means, a laptop stabilizing means, a gripping means, an electrical power connecting means, laptop remote controlling means, a trackball/mouse controlling means, and data input/output means.

* * * * *